US007530189B2

(12) United States Patent
Kim et al.

(10) Patent No.: US 7,530,189 B2
(45) Date of Patent: May 12, 2009

(54) AIR CONDITIONER

(75) Inventors: Ji Hoon Kim, Jinhae-si (KR); Joong Gil Yoo, Seongnam-si (KR); Ki Jung Yoo, Seoul (KR); Hee Jae Kwon, Seoul (KR)

(73) Assignee: LG Electronics Inc., Seoul (KR)

( * ) Notice: Subject to any disclaimer, the term of this patent is extended or adjusted under 35 U.S.C. 154(b) by 500 days.

(21) Appl. No.: 11/326,394

(22) Filed: Jan. 6, 2006

(65) Prior Publication Data

US 2006/0168862 A1 Aug. 3, 2006

(30) Foreign Application Priority Data

Feb. 1, 2005 (KR) ..... 10-2005-0009308
Feb. 1, 2005 (KR) ..... 10-2005-0009309

(51) Int. Cl.
*A47G 1/06* (2006.01)

(52) U.S. Cl. ..... 40/725; 62/263

(58) Field of Classification Search ..... 40/724, 40/725; 62/263; 312/204, 227, 234, 237
See application file for complete search history.

(56) References Cited

U.S. PATENT DOCUMENTS 3,553,873 A * 1/1971 Weston ..... 40/711
3,665,628 A 5/1972 Dammond
4,332,114 A * 6/1982 Goebel et al. ..... 62/262
4,733,542 A * 3/1988 Blair ..... 62/263
4,733,543 A * 3/1988 Blair ..... 62/263
5,012,600 A 5/1991 Wang
5,373,654 A * 12/1994 Whalen ..... 40/716
5,807,170 A 9/1998 Lee
6,018,955 A * 2/2000 Kaneko et al. ..... 62/125
6,922,930 B1 * 8/2005 Grayson ..... 40/711
2002/0189274 A1 * 12/2002 Lee et al. ..... 62/298
2003/0145618 A1 8/2003 Moon et al.

FOREIGN PATENT DOCUMENTS

EP 1 271 065 A2 1/2003
GB 1 536 121 12/1978
JP 03213921 A 9/1991
JP 5-187706 A 7/1993
JP 10-185232 A 7/1998
KR 10-2002-0033880 5/2002
KR 10-2005-0024798 3/2005

* cited by examiner

*Primary Examiner*—Gary C Hoge
(74) *Attorney, Agent, or Firm*—Birch, Stewart, Kolasch & Birch, LLP

(57) ABSTRACT

An air conditioner is provided. In the air conditioner, a panel frame is mounted on a front of a main body, a front panel is movably installed in the panel frame, and a front cover is detachably mounted on the front panel.

15 Claims, 8 Drawing Sheets

AIR CONDITIONER

BACKGROUND OF THE INVENTION

1. Field of the Invention

The present invention relates to an air conditioner, and more particularly, to an air conditioner that is designed to be associated with a picture or photograph, thereby providing an improved external appearance as well as its inherent air-conditioning effect.

2. Description of the Related Art

Generally, an air conditioner is operated as a refrigerant goes through a cooling cycle having a series of processes such as a compression process, a condensing process, an expanding process, and a vaporizing process. That is, after the refrigerant is compressed to a high temperature and pressure state, heat is discharged to an outer side by a condenser. Then, the temperature and pressure of the refrigerant are lowered as it goes through an expansion valve. Then, the refrigerant goes through the vaporizer to absorb heat and returns to the condenser.

Here, the compression, condensing and expansion processes are performed in an indoor unit of the air conditioner. The vaporizing process is performed by a blower fan and a heat exchanger.

Meanwhile, the air conditioner is generally classified into a window type air conditioner that is designed to be mounted on a window and to integrate a cooling cycle device therein and a sprit air conditioner having indoor and outdoor units that are separated from each other and installed on indoor and outdoor sides, respectively.

The sprit air conditioner is further classified according to an installing method of the indoor unit into a wall-mounted type, a standing type, a ceiling-mounted type, and a ceiling-buried type.

There is also provided a convertible type indoor unit that can be used any one of the wall-mounting type, the standing type and ceiling-mounted type.

Meanwhile, the indoor unit of the air conditioner is classified according to locations of air intake and outlet into a variety of types. For example, in a type where indoor air is introduced through a side portion of the indoor unit and exhausted through a front portion of the indoor unit, a louver is installed on the front portion of the indoor unit to uniformly distribute the air in the indoor room by rotating up and down and left and right.

In the typical indoor unit of the air conditioner, the front portion is designed to simply function as a cover. That is, a front cover defining the front portion of the indoor unit functions to prevent a variety of parts such as an air intake fan, a heat exchanger and the like that are installed inside the indoor unit to be exposed outward, thereby preventing a user from getting electric shock by touching the parts installed inside the indoor unit. That is, since the front cover is designed considering only the simple functions, it cannot affect on improving the interior atmosphere.

SUMMARY OF THE INVENTION

Accordingly, the present invention is directed to an air conditioner that substantially obviates one or more problems due to limitations and disadvantages of the related art.

An object of the present invention is to provide an air conditioner that is designed to be associated with a picture or photograph, thereby providing an improved external appearance as well as its inherent air-conditioning effect.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an air conditioner including: a main body; a panel frame mounted on a front of the main body; a front panel movably installed in the panel frame; and a front cover detachably mounted on the front panel.

In another aspect of the present invention, there is provided an air conditioner including: a main body; a transparent panel frame mounted on a front of the main body; a light-emitting unit installed in the main body; a front panel movably installed in the panel frame to open and close an intake opening defined in the panel frame; and a front cover detachably mounted on the front panel.

In still another aspect of the present invention, there is provided an air conditioner including: a main body in which a heat exchanger and a blower fan are installed; a panel frame mounted on a front of the main body; a front panel installed in the panel frame to open and close an intake opening of the panel frame through rotational or translational motion; and a front cover detachably mounted on a front of the front panel, the front cover including a transparent outer case, a supporting panel coupled with the outer case, and an interchangeable art panel disposed between the outer case and the supporting panel.

According to the present invention, since an artwork or a picture can be displayed on the front portion of the indoor unit, the interior atmosphere can be improved.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
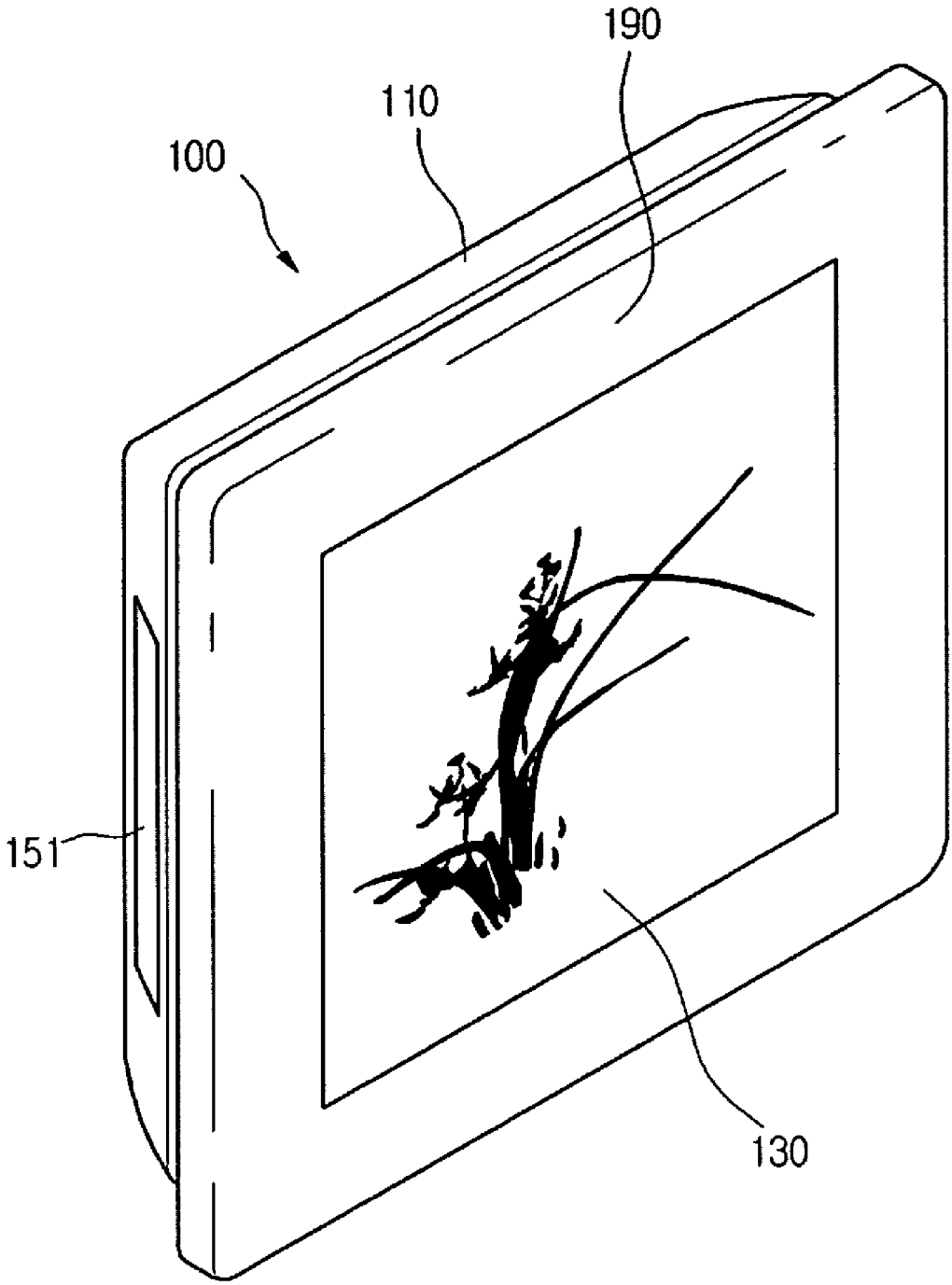
FIG. 1 is a perspective view of an indoor unit of an air conditioner according to the present invention.
Figure 2:
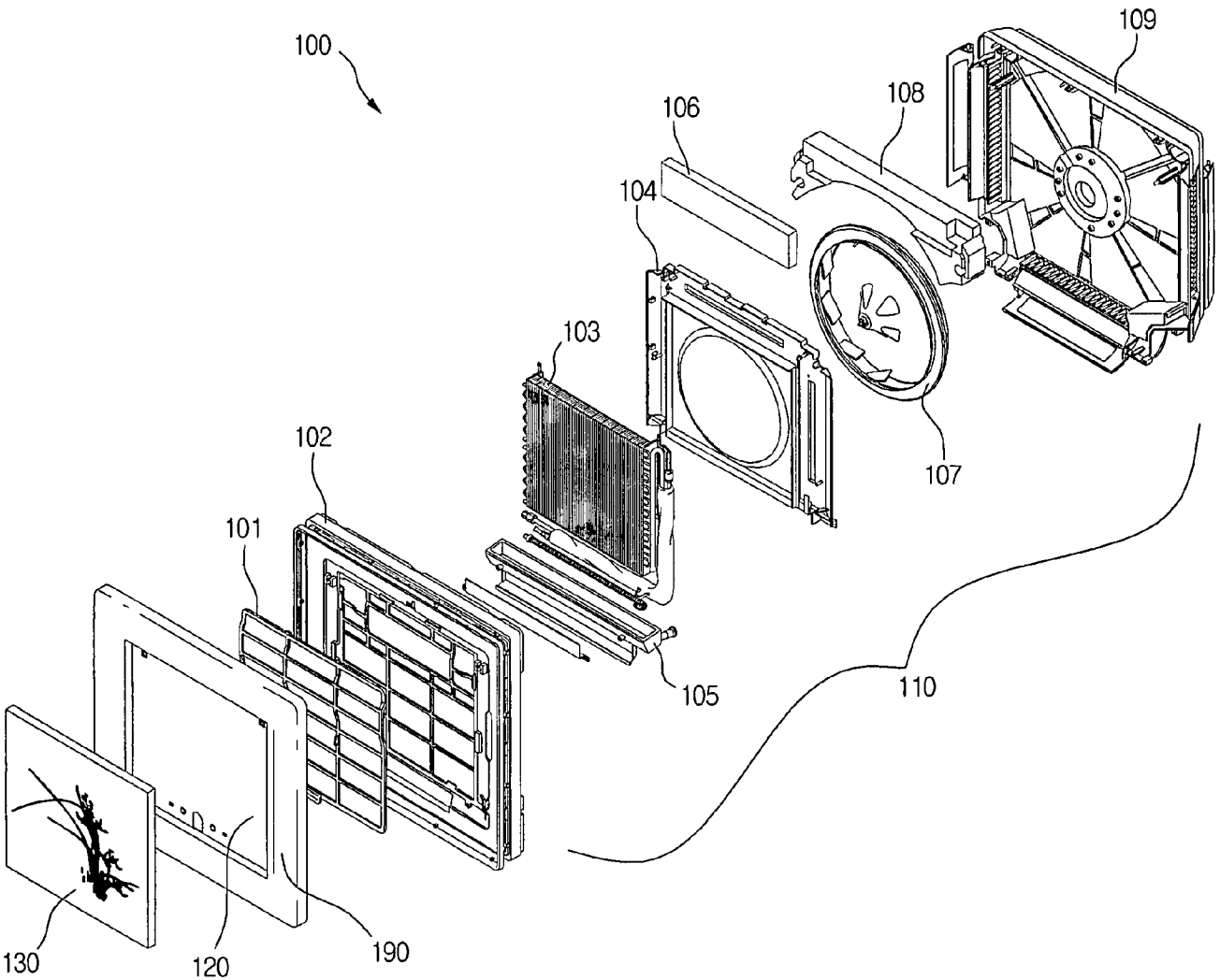
FIG. 2 is an exploded perspective view of the indoor unit depicted in FIG. 1.

FIG. 1 is a perspective view of an indoor unit of an air conditioner according to the present invention, and FIG. 2 is an exploded perspective view of the indoor unit depicted in FIG. 1.

Referring to FIGS. 1 and 2, an indoor unit 100 includes a main body 110 forming the exterior of the unit, a panel frame 190 mounted on a front of the main body 110, a front panel 120 mounted in the panel frame 190, and a front cover 130 detachably coupled to a front of the front panel 120 for having a picture or photograph inserted therein. The front panel 120 can be slid back and forth or rotated about an edge thereof to allow airflow through the panel frame 190.

When the front panel 120 is slit or rotated in a front direction, an intake opening (refer to 150 in FIGS. 3 and 4) is exposed to atmosphere. Indoor air is sucked through the intake opening 150 and then it is discharged through a discharge bent 151 formed on a side of the main body 110.

The main body 110 further includes a filter 101 for filtering impurities from the indoor air, a front frame 102 disposed behind the filter 101 for installing the filter thereon and protecting inside components, a base 109 coupled to the front frame 102, and a blower fan 107 installed between the front frame 102 and the base 109 for drawing indoor air into the unit.

Additionally, the main body 110 includes a heat exchanger 103 installed in front of the blower fan 107 for lowering the temperature of indoor air drawn into the unit, a drain pan 105 disposed below the heat exchanger 103 for collecting moisture that condenses on and drips from the heat exchanger 103, an air guide 104 installed behind the heat exchanger 103 for directing the flow of indoor air drawn into the unit, an electronics housing 106 disposed above the air guide 104 for housing electronic components, and a guide duct 108 for causing indoor air drawn into the unit by the blower fan 107 to be discharged from the unit.

An explanation of the operation and function of the indoor unit 100 of an air conditioner according to the present invention will now be set forth.

First, when electrical current is applied to the indoor unit 100, the front panel 120 disposed at the front of the main body 110 is opened to expose the intake opening 150. At the same time that the front panel 120 moves to expose the intake opening 150, the blower fan 107 inside the main body 110 begins spinning. The spinning blower fan 107 draws indoor air through the intake opening 150 into the unit. The drawn air sheds its impurities as it passes through the filter 101, and proceeds through the heat exchanger 103 to exchange heat with refrigerant therein. When the air passes through the heat exchanger 103, its temperature drops, and it is then directed via the air guide 104 towards the blower fan 107. The air is then guided by the guide duct 108 disposed above the blower fan 107 so that it is finally discharged through the discharge vent 151 back to the indoor space.

As explained above, the front cover 130 is detachably coupled to the front panel 120 disposed on the front of the main body 110.

Figure 3:
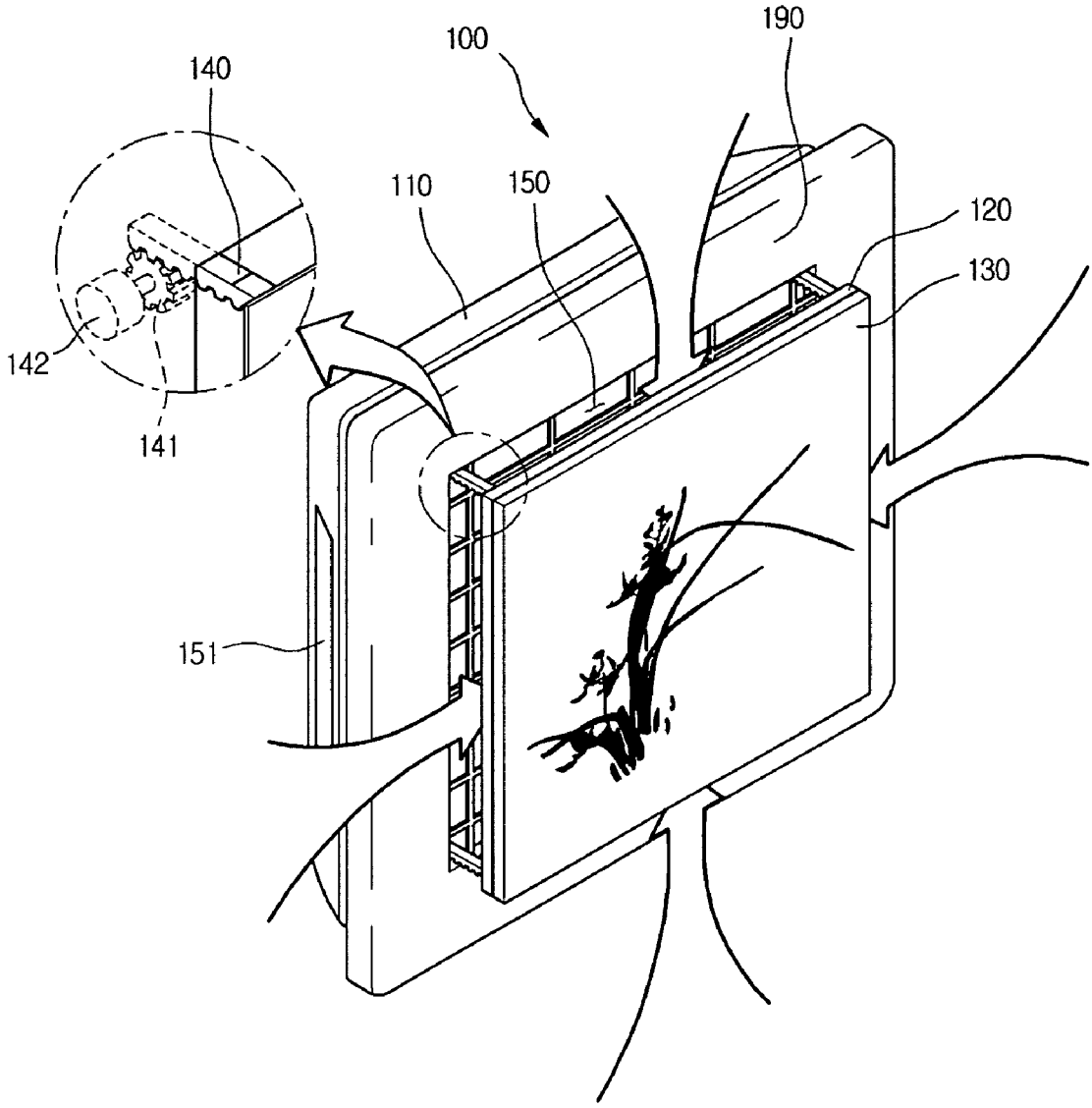
FIG. 3 is a perspective view showing an operation of an indoor unit of an air conditioner according to an embodiment of the present invention.

FIG. 3 is a perspective view showing an operation of an indoor unit of an air conditioner according to an embodiment of the present invention.

Referring to FIG. 3, an indoor unit 100 includes a main body 110, a panel frame 190 mounted on a front of the main body 110, a front panel 120 movably installed in the panel frame 190, and a front cover 130 attached on a front of the front panel 120.

In operation, the front panel 120 is moved outward to open an intake opening 150. Indoor air is sucked through the intake opening 150 and cooled in the main body 110. The cooled air is discharged through a discharge vent 151 from the main body 110.

The indoor unit 100 further includes at least one toothed rack 140 installed on a back of the front panel 120. Four racks 140 may be installed on four corners of the front panel 120 for a horizontal translation of the front panel 120. Further, the indoor unit 100 includes at least one rotary member such as a pinion 141 engaged with the rack 140 and at least one driving unit such as a step motor 142 coupled with the pinion 141. Rotational motion of the step motor 142 can be converted into linear motion by the combination of the pinion 141 and the rack 140, such that the front panel 120 can be exactly translated back and forth.

Figure 4:
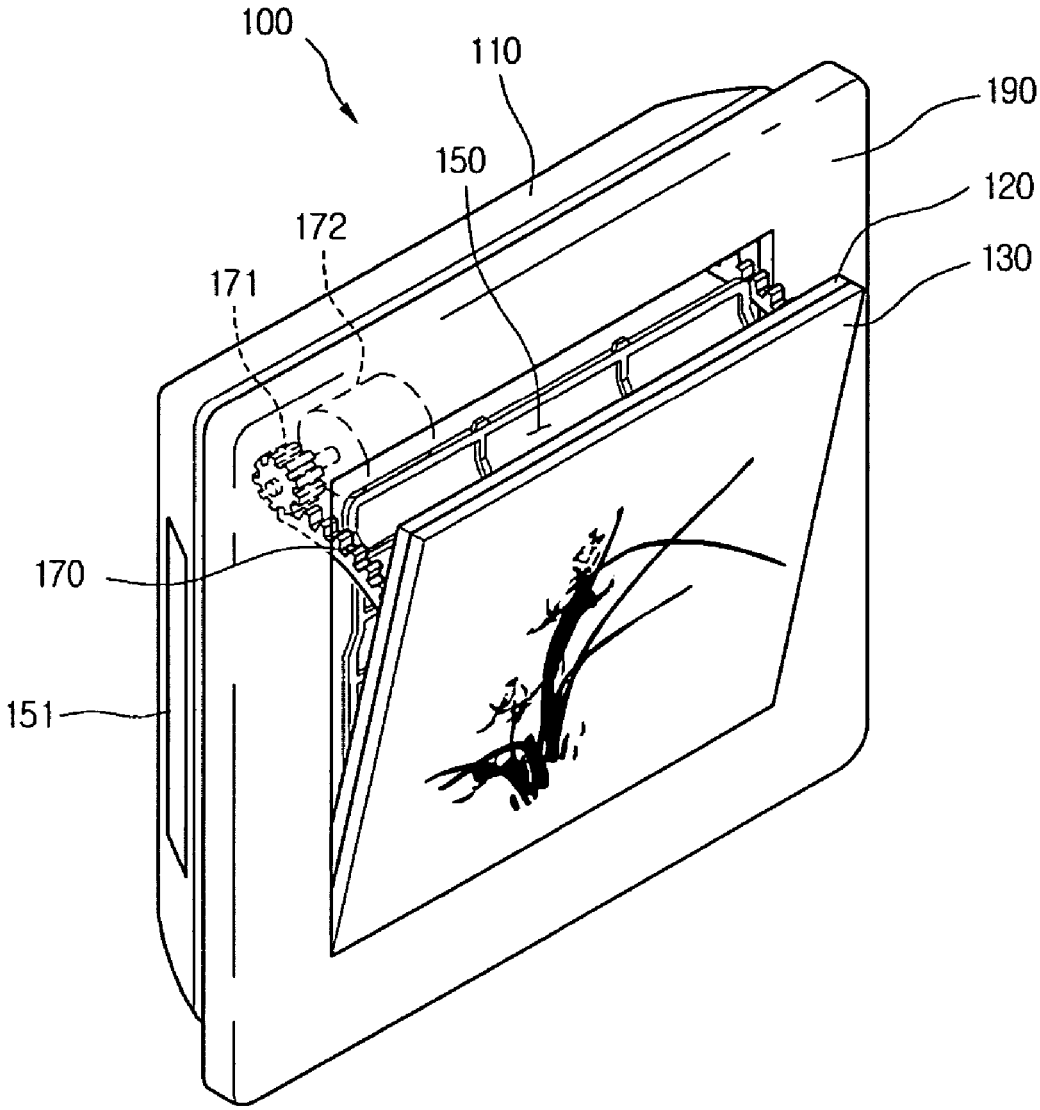
FIG. 4 is a perspective view showing an operation of an indoor unit of an air conditioner according to another embodiment of the present invention.

FIG. 4 is a perspective view showing an operation of an indoor unit of an air conditioner according to another embodiment of the present invention.

Referring to FIG. 4, an indoor unit 100 includes a front panel 120. The front panel 120 can be rotated about an edge thereof to expose an intake opening 150.

In detail, the indoor unit 100 further includes a rack 170 on an upper back of the front panel 120, a rotary member such as a pinion 171 engaged with the rack 170, and a driving unit such as a step motor 172 coupled with the pinion 171. Upon rotation of the step motor 172, the rack 170 is moved back and forth to rotate the front panel 120 about a bottom edge. The rack 170 may be curved to smoothly rotate the front panel 120.

Though the indoor unit 100 is designed to rotate the front panel 120 about the bottom edge in this embodiment, the indoor unit 100 can be designed to rotate the front panel 120 about a top or side edge of the front panel 120.

Figure 5:
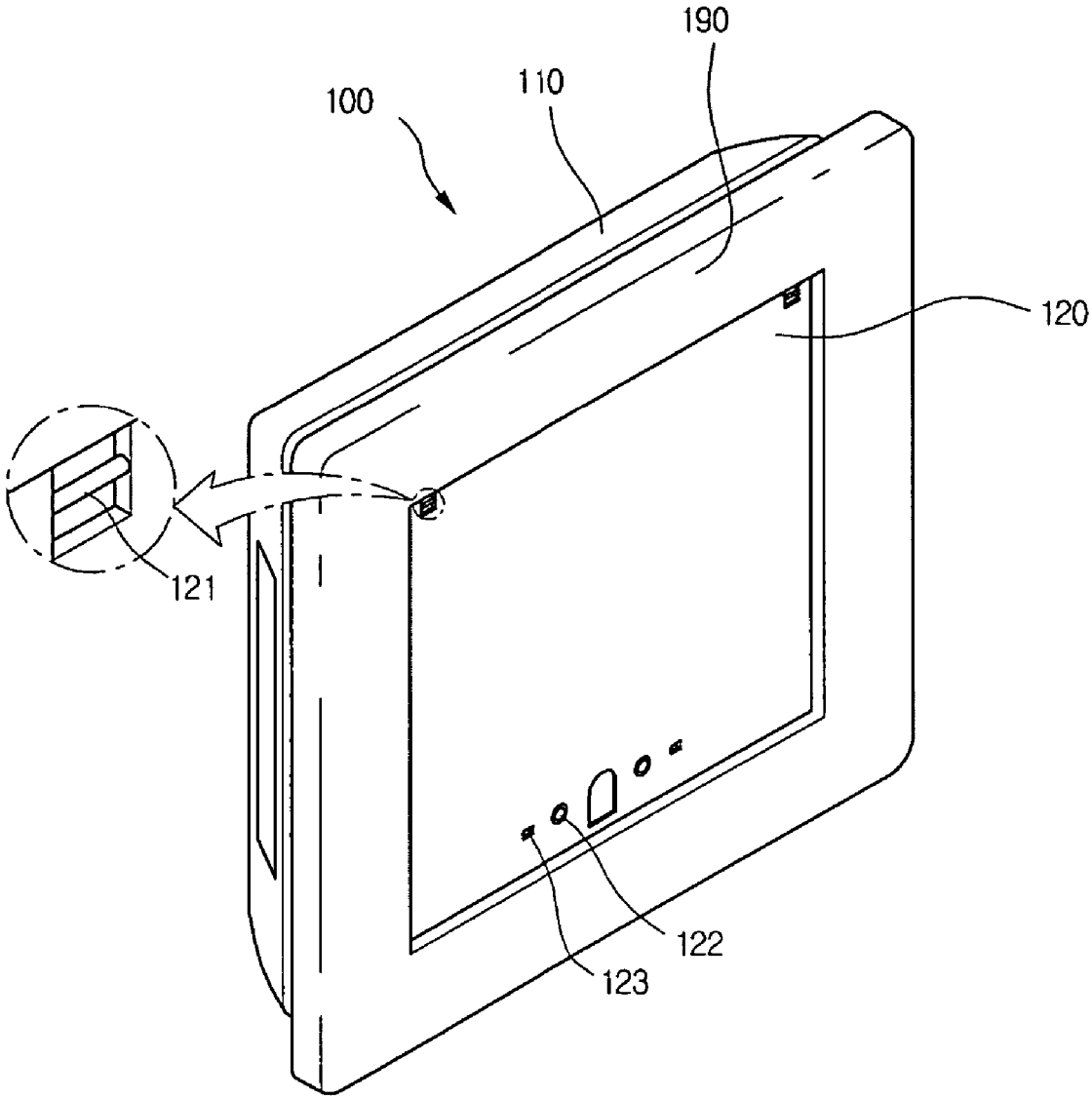
FIG. 5 is a perspective view of an indoor unit of an air conditioner when a front cover of the indoor unit is removed according to the present invention.

FIG. 5 is a perspective view of an indoor unit of an air conditioner when a front cover of the indoor unit is removed according to the present invention.

Referring to FIG. 5, the indoor unit 100, as described above, includes the main body 110, the panel frame 190 mounted on a front of the main body 110, and the front panel 120 movably installed in the panel frame 190.

The front panel 120 includes at least one hook end 121 for coupling with the front cover 130. The hook end 121 may be formed on each upper side of the front panel 120 to hook an upper portion of the front cover 130 thereon. Further, the front panel 120 includes at least one coupling portion at a lower side to fix a lower portion of the front cover 130 thereto. The coupling portion may be a hook hole 123 (two are shown) to receive a hook (refer to 135 in FIG. 6) formed on a back of the front cover 130. Further, the front panel 120 includes at least one elastic member 122 to push the front cover 130 when pressed. That is, to separate a lower portion of the front cover 130 from the front panel 120, a use can press the lower portion of the front cover 130 once. After that, the user can lift up the front cover 130 and rotate it about the hook end 121 to remove the front cover 130 from the front panel 120.

Figure 6:
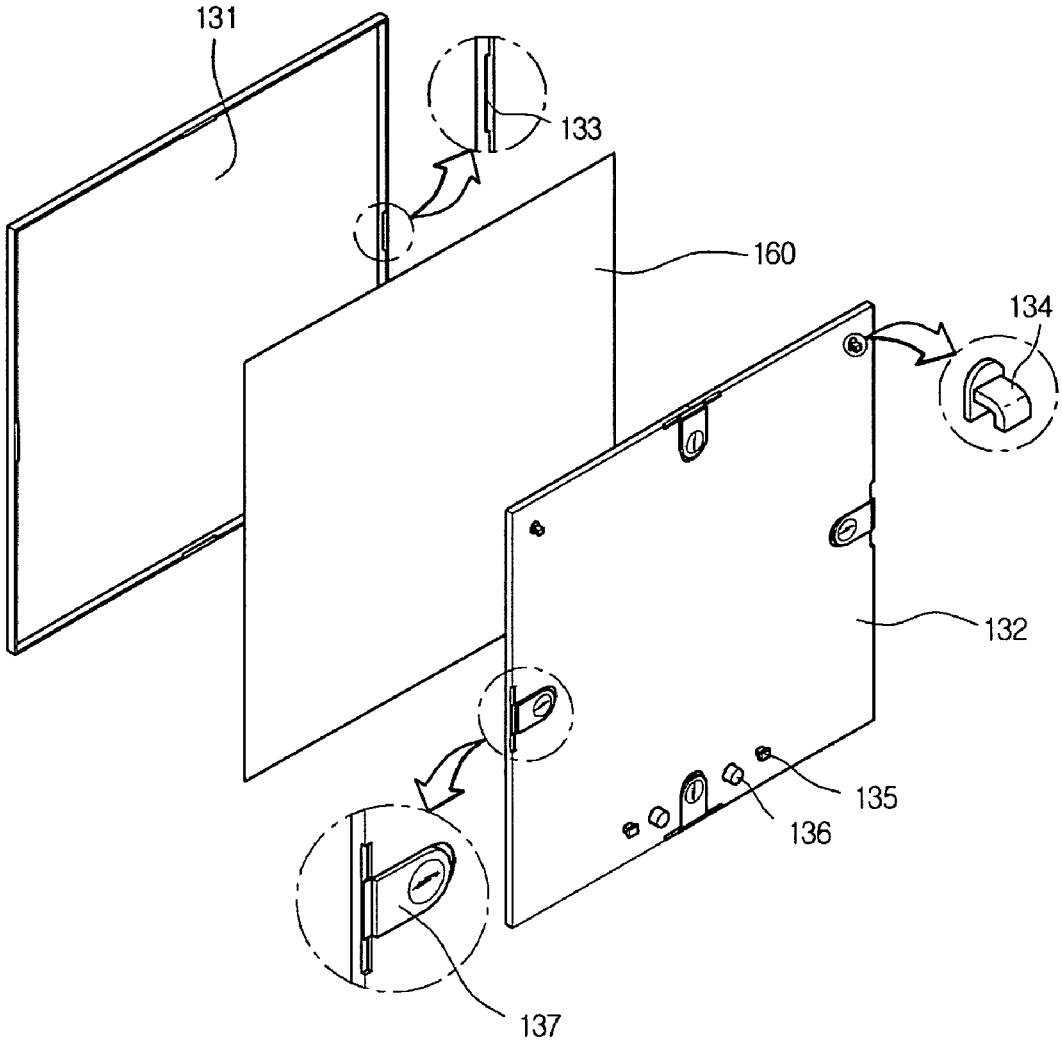
FIG. 6 is an explode perspective view of a front cover that can be mounted on an indoor unit according to the present invention.

FIG. 6 is an explode perspective view of a front cover that can be mounted on an indoor unit according to the present invention.

Referring to FIG. 6, the front cover 130 includes an art panel 160 on which a picture or photograph is printed, a first cover such as a transparent outer case 131 to be coupled to a front of the art panel 160 to protection the art panel 160, and a second cover such as a supporting panel 132 for coupling with the outer case 131 from a back of the art panel 160.

The supporting panel 132 includes at least one mounting/dismounting member 137 on a back for coupling with the outer case 131. The mounting/dismounting member 137 is designed such that the outer case 131 can be separated from the supporting panel 132 by pushing the mounting/dismounting member 137 toward a center of the supporting panel 132. On the contrary, the outer case 131 can be coupled to the supporting panel 132 by pushing the mounting/dismounting member 137 away from the center of the supporting panel 132 after putting the art panel 160 and the outer case 131 on the supporting panel 132.

The outer case 131 defines at least one insertion slot 133 to receive the mounting/dismounting member 137 when the outer case 131 and the supporting panel 132 are coupled.

The coupling structure for the outer case 131 and the supporting panel 132 is not limited to the illustrated and described structure. Various coupling structures such as a hook structure can be used.

The supporting panel 132 further includes at least one hook loop 134 on a back for coupling with the hook end 121 formed on a front of the front panel 120. The supporting panel 132 further includes coupling portions such as at least one magnet 136 and at least one hook 135 on a lower back. The hook 135 is designed for coupling with the hook hole 123 defined in a front of the front panel 120. The magnet 136 is designed to be attached to the elastic member 122 by magnetic force. That is, the hook 135 and magnet 136 are provided to securely couple the front cover 130 to the front panel 120. The coupling loop 134 of the front cover 120 and the hook end 121 of the front panel 120 are designed such that the front cover 130 can be rotated about the hook end 121 when the front cover 130 is coupled to and removed from the front panel 120.

To detach the front cover 130 from the front panel 120, a user can press a lower end of the front cover 130 once to extend the elastic member 122 outward. By the extended elastic member 122, the lower end of the front cover is spaced apart from the front panel 120. In this position, the user can lift up the front cover 130 and rotate it about the hook end 121 to remove the front cover 130 from the front panel 120.

The coupling structure of the front cover 130 and the front panel 120 is not limited to this embodiment. Various structures can be employed for the coupling between the front cover 130 and the front panel 120.

Figure 7:
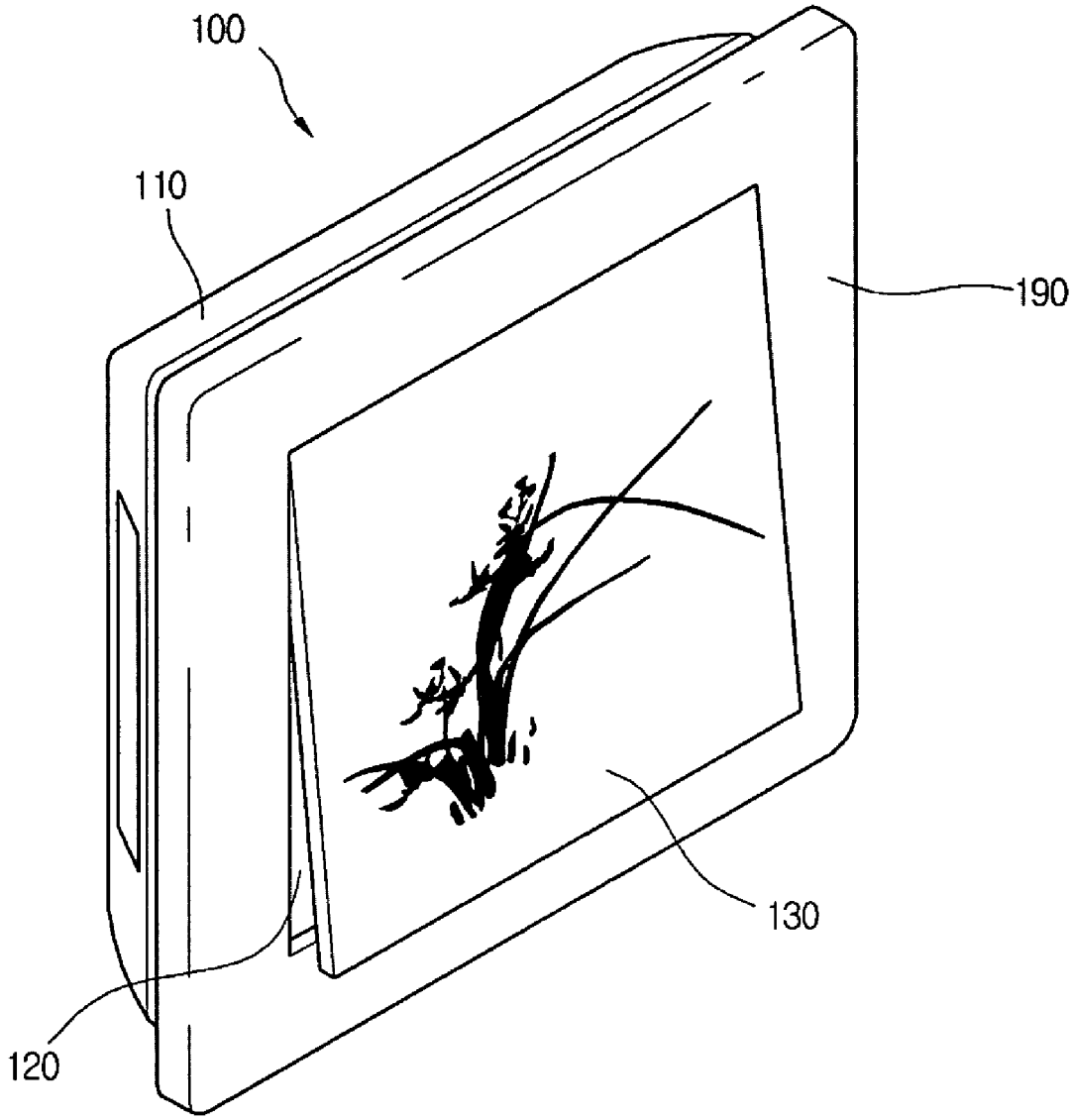
FIG. 7 is a perspective view showing detachment of a front cover from an indoor unit according to the present invention.

FIG. 7 is a perspective view showing detachment of a front cover from an indoor unit according to the present invention.

Referring to FIG. 7, the front cover 130 can be detached from the front panel 120 to replace the picture or photograph with new one.

As explained above, to detach the front cover 130 from the front panel 120, a user can press the front cover 130 once from the lower end to extend the elastic member 122 outward. The elastic member 122 as it extends outward pushes the lower end of the font cover 130 outwardly. After the lower end of the front cover 130 is spaced apart from the front panel 120, the user can lift up the front cover 130 and pull the front cover 130 out of the front panel 120 while rotating the front cover 130 about the hook end 121.

After that, the user can push the mounting/dismounting member 137 toward the center of the supporting panel 132 to detach the outer case 131 from the supporting panel 132. Then, the user can replace the art panel 160 with new one having a different picture or photograph.

In this example, the front cover 130 is rotated about a top end thereof when it is removed from the front panel 120. As another example, the front cover 130 can be designed to be rotated about a bottom end or a lateral end.

Figure 8:
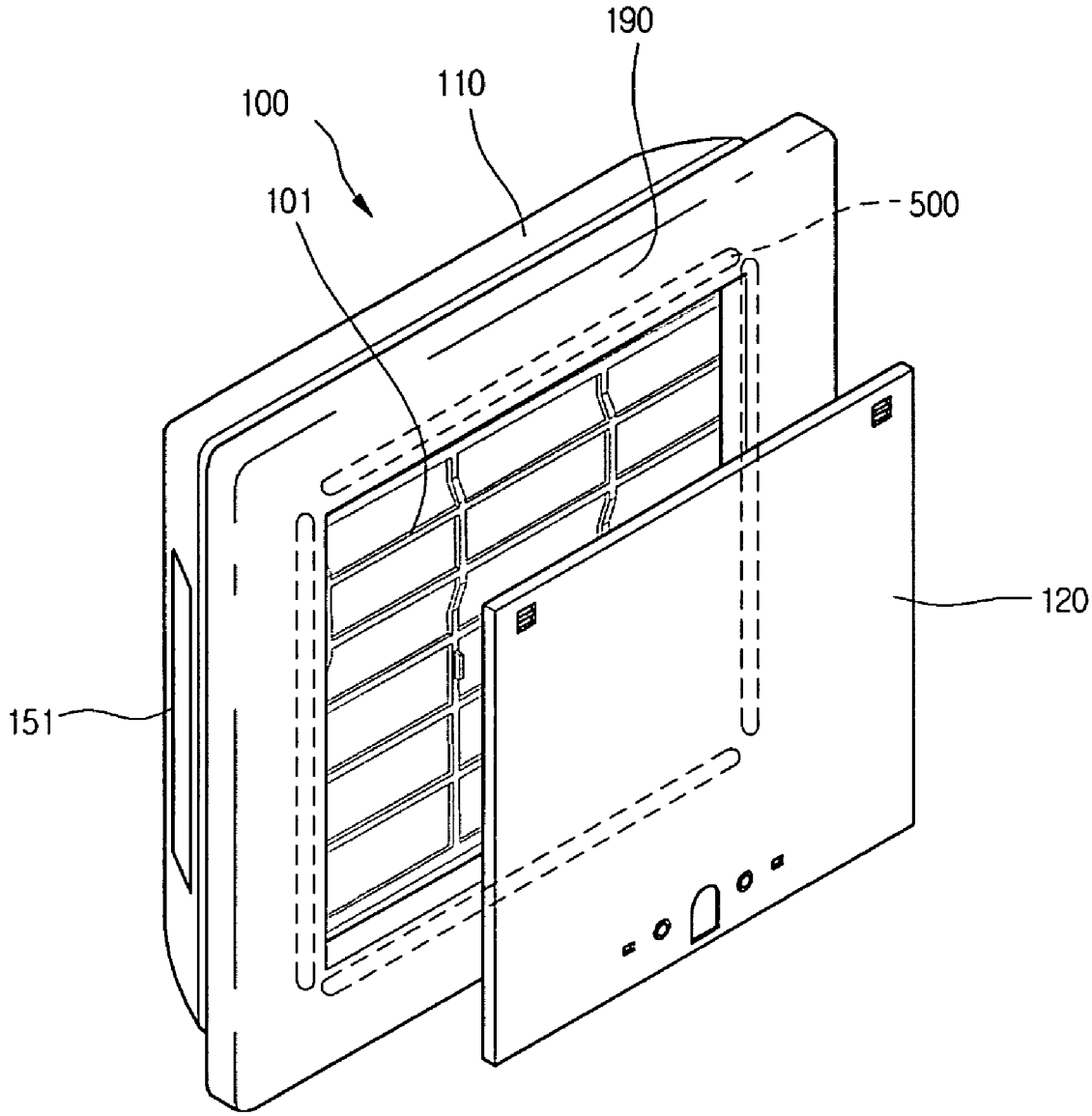
FIG. 8 is a perspective view showing a light-emitting unit installed in an indoor unit of an air conditioner according to the present invention.

FIG. 8 is a perspective view showing a light-emitting unit installed in an indoor unit of an air conditioner according to the present invention.

Referring to FIG. 8, the indoor unit 100 includes at least one light-emitting unit 500 installed in the main body 110. Light from the light-emitting unit 500 passes through the panel frame 190 to illuminate the periphery of the indoor unit 100.

The light-emitting unit 500 is installed close to an inner edge of the frame panel 190 to emit light to the outside through the frame panel 190. By illuminating around the indoor unit 100 with the light-emitting unit 500, the indoor unit can provides a better beautifulness. The light color of the light-emitting unit 500 can be selected depending on the circumstance to increase decorative function of the indoor unit 100. Further, the light-emitting unit 500 is detachably installed in the main body 110, such that various colors and intensities of light can be provided by replacing the light-emitting unit 500. Furthermore, the transparency and color of frame panel 190 can be selected to provide more variety in illumination. The light-emitting unit 500 may be controlled to emit light all the time or only when the indoor unit 100 is operated.

In addition, some of the light from the light emitting unit 500 can be directed to the outside through the front cover 130 to illuminate the picture or photograph of the art panel 160.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An air conditioner comprising:

a main body;

a heat exchanger installed in the main body for heat exchange with indoor air;

a blower fan for drawing the indoor air into the main body and blowing the drawn air back to the indoors;

a panel frame mounted on a front of the main body, the panel frame defining closed shaped edges of the front surface of the main body;

a front panel movably installed in the panel frame, the indoor air being introduced to a gap which is formed by the movement of the front panel; and a front cover detachably mounted on the front panel, wherein the front cover includes:

a transparent outer case;

a supporting panel detachably coupled with the outer case; and an interchangeable art panel disposed between the outer case and the supporting panel.

2. The air conditioner according to claim 1, wherein the supporting panel includes at least one mounting/dismounting member on a back, and the outer case includes at least one insertion slot in an edge to receive the mounting/dismounting member.

3. The air conditioner according to claim 1, wherein the front panel is capable of translational motion in forward and backward directions.

4. The air conditioner according to claim 1, further comprising:

at least one rack formed on a back of the front panel with a straight shape for the movement of the front panel;

at least one pinion engaged with the rack; and at least one motor coupled with the pinion to rotate the pinion.

5. The air conditioner according to claim 1, further comprising:

at least one hook end formed on a front of the front panel for detachably mounting the front cover on the front panel; and at least one hook loop formed on a back of the front cover for detachable coupling with the hook end.

6. The air conditioner according to claim 1, further comprising:

a hook formed on a back of the front cover; and a hook hole defined in front panel to receive the hook.

7. The air conditioner according to claim 1, wherein the panel frame is made of transparent material.

8. The air conditioner according to claim 1, further comprising a light -emitting unit installed in the main body to emit light with a specific color.

9. The air conditioner according to claim 8, wherein the light-emitting unit is installed close to the panel frame.

10. The air conditioner according to claim 8, wherein the light-emitting unit emits light toward the panel frame and/or a front portion of the front cover.

11. The air conditioner according to claim 8, wherein the light-emitting unit is interchangeable with another one emitting different color light.

12. The air conditioner according to claim 1, wherein the front panel is rotatable about an edge thereof by a predetermined angle.

13. The air conditioner according to claim 1, further comprising:

at least one rack formed on a back of the front panel with a curved shape for the movement of the front panel;

at least one pinion engaged with the rack; and at least one motor coupled with the pinion to rotate the pinion.

14. The air conditioner according to claim 1, further comprising:

an elastic member formed on a predetermined portion of the front panel to push the front cover outwardly; and a magnet formed on a back of the front cover for coupling with the elastic member by magnetic force.

15. The air conditioner according to claim 14, wherein the elastic member is retracted into the front panel when pressed once and extended outward from the front panel when pressed again.

* * * * *